US007404476B2

(12) United States Patent
Yoshida

(10) Patent No.: US 7,404,476 B2
(45) Date of Patent: Jul. 29, 2008

(54) ESCALATOR AND SKIRT END STRUCTURE

(75) Inventor: Masato Yoshida, Himeji (JP)

(73) Assignee: Toshiba Elevator Kabushiki Kaisha, Tokyo-To (JP)

( * ) Notice: Subject to any disclaimer, the term of this patent is extended or adjusted under 35 U.S.C. 154(b) by 0 days.

(21) Appl. No.: 10/575,103

(22) PCT Filed: Oct. 8, 2004

(86) PCT No.: PCT/JP2004/015304

§ 371 (c)(1),
(2), (4) Date: Nov. 17, 2006

(87) PCT Pub. No.: WO2005/035426

PCT Pub. Date: Apr. 21, 2005

(65) Prior Publication Data

US 2007/0084696 A1 Apr. 19, 2007

(30) Foreign Application Priority Data

Oct. 10, 2003 (JP) ..... 2003-352302

(51) Int. Cl.
*B66B 27/00* (2006.01)

(52) U.S. Cl. ..... 198/324; 198/322

(58) Field of Classification Search ..... 198/321–324
See application file for complete search history.

(56) References Cited

U.S. PATENT DOCUMENTS 5,431,271 A * 7/1995 Abraham et al. ..... 198/324
5,782,330 A * 7/1998 Mehlert et al. ..... 198/324
5,923,005 A 7/1999 Blondiau et al.
6,334,522 B2 * 1/2002 Haruta et al. ..... 198/322
6,988,607 B2 * 1/2006 Blondiau et al. ..... 198/322
7,134,539 B2 * 11/2006 Kim ..... 198/338
7,249,667 B2 * 7/2007 Sansevero et al. ..... 198/324
2007/0023256 A1 * 2/2007 Skolnick

FOREIGN PATENT DOCUMENTS

| | | |
|---|---|---|
| DE | 198 26 773 | 12/1999 |
| EP | 0 676 363 | 10/1995 |
| JP | 63-123575 | 8/1988 |
| JP | 07-285774 | 10/1995 |
| JP | 07285774 | 10/1995 |
| KR | 10-2006-0002897 | 1/2006 |
| WO | WO 2004/099040 A1 | 11/2004 |

* cited by examiner

*Primary Examiner*—Douglas A Hess
(74) *Attorney, Agent, or Firm*—Oblon, Spivak, McClelland, Maier & Neustadt, P.C.

(57) ABSTRACT

An escalator, having a pair of balustrades disposed on both sides of traveling steps, includes a balustrade end, a skirt end portion, and an indicator. The balustrade end is configured to turn back a handrail belt wound around each of the balustrades. The skirt end portion has a belt entrance port configured to receive the handrail belt, and an outer edge of the skirt end portion furthest away from the traveling steps extends further in an axial direction of the traveling steps than an inner edge of the skirt end portion closest to the traveling steps to guide items towards the traveling steps. The indicator is configured to indicate operating conditions of the escalator. A front face of the skirt end portion includes an inclined surface at a predetermined angle with a vertical plane. A display face of the indicator conforms to the inclination of the inclined surface.

18 Claims, 3 Drawing Sheets

"Background Art"

ESCALATOR AND SKIRT END STRUCTURE

BACKGROUND OF THE INVENTION

1. Field of the Invention

The present invention relates to an escalator, and more particularly to an escalator with a concentrated arrangement of instruments, such as an indicator, in a skirt end portion of an escalator balustrade end and to a skirt end structure.

2. Background Art

FIG. 5 shows a balustrade end of a conventional escalator. In FIG. 5, reference numeral 1 denotes a balustrade end, and 2 denotes a handrail belt moving in the direction of the arrow. A skirt end portion 3 is positioned at the bottom of the balustrade end 1.

In the conventional escalator, a handrail belt entrance port 4 is provided in the front face of the skirt end portion 3. Further, in general, an indicator 5 for indicating the operating conditions, such as the traveling direction of steps, is provided in the front face of the skirt end portion 3.

According to the conventional escalator, the balustrade end 1 protrudes from the skirt end portion 3 toward the entrance. Accordingly, the indicator 5 provided in the skirt end portion 3 is hardly visible to a passenger, who is about to ride the escalator from the entrance, depending on the height of the passenger's eyes because of blocking by the balustrade end 1. Especially in the case where the indicator 5 is provided in only one of the balustrade ends 1, the indicator 5 can get completely out of a passenger's sight depending upon the passenger's position at the entrance.

Further, in the skirt end portion 3 of the conventional escalator, the space between the handrail belt 2, entering the handrail belt entrance port 4, and the floor is so narrow that there is a risk that passenger's baggage or the like could get caught in the space.

The conventional escalator also involves the problem that when a passenger, upon riding the escalator, lets a shopping cart hit against the front face of the skirt end portion in an attempt to pull the shopping cart in, the shopping cart can be bound not toward the steps, but toward the floor depending upon how the shopping cart is hit, whereby the shopping cart can be left behind on the floor and, in some situations, the passenger could fall down.

SUMMARY OF THE INVENTION

It is therefore an object of the present invention to solve the above problems in the prior art and provide an escalator having a skirt end portion which is improved in the visibility of an indicator, etc. and in the safety of the transport of passengers.

In order to achieve the object, the present invention provides an escalator, having a pair of balustrades disposed on both sides of traveling steps, comprising: a balustrade end for turning back a handrail belt wound around on each said balustrade; a skirt end portion having a belt entrance port for the handrail belt; and an indicator for indicating the operating conditions of the escalator, wherein the front face of the skirt end portion includes an inclined surface at predetermined angles with a vertical plane and with the direction of passengers' riding from the entrance to the escalator, and the indicator is disposed such that its display face conforms to the inclination of the inclined surface.

Preferably, the angle of the inclined surface with a vertical plane is 5 to 30° and the angle of the inclined surface with the direction of passengers' riding is 45 to 85°.

In a preferred embodiment of the present invention, the lower end edge of the front face of the skirt end portion is positioned forward of the belt entrance port.

In a preferred embodiment of the present invention, the belt entrance port of the skirt end portion projects from the front face of the skirt end portion and has an inclined end surface having an opening. The end surface of the belt entrance port is inclined preferably at an angle of 60 to 85° with respect to a horizontal plane. It is also preferred that the moving direction of the handrail belt at the belt entrance port make an angle of 5 to 30° with a horizontal plane.

In a preferred embodiment of the present invention, the height of the belt entrance port of the skirt end portion from a floor is at least 170 mm.

In a preferred embodiment of the present invention, the front face of the skirt end portion comprises a gently curved surface with rounded corners.

In a preferred embodiment of the present invention, the skirt end portion is adapted for concentrated arrangement of various instruments such as a switch, a sensor and an indicator.

Further, in a preferred embodiment of the present invention, the skirt end portion is comprised of an exchangeable unitized structure mountable to the balustrade end.

According to the present invention, even when a passenger, who intends to ride the escalator, comes close to the entrance, an indicator can be prevented from being hidden behind the balustrade end and hardly visible to the passenger. Thus, the visibility of the indicator can be significantly enhanced.

The present invention can provide a large space between the floor and the balustrade end, thereby lowering the risk of baggage, etc. being caught between the floor and the belt entrance port.

According to the present invention, the skirt end portion can be so designed that a shopping cart or the like, when it is hit against the skirt end portion, is guided to the direction of the passenger's movement. This can prevent a jam at the entrance as well as a falling accident of a passenger due to rebound of a shopping cart toward the floor.

Furthermore, the present invention enables concentrated arrangement of instruments for driving, operation and safety of the escalator in the skirt end portion. This can improve the working efficiency for their maintenance by the operator.

DETAILED DESCRIPTION OF THE PREFERRED EMBODIMENT

An escalator according to a preferred embodiment of the present invention will now be described in detail with reference to the drawings.

Figure 1:
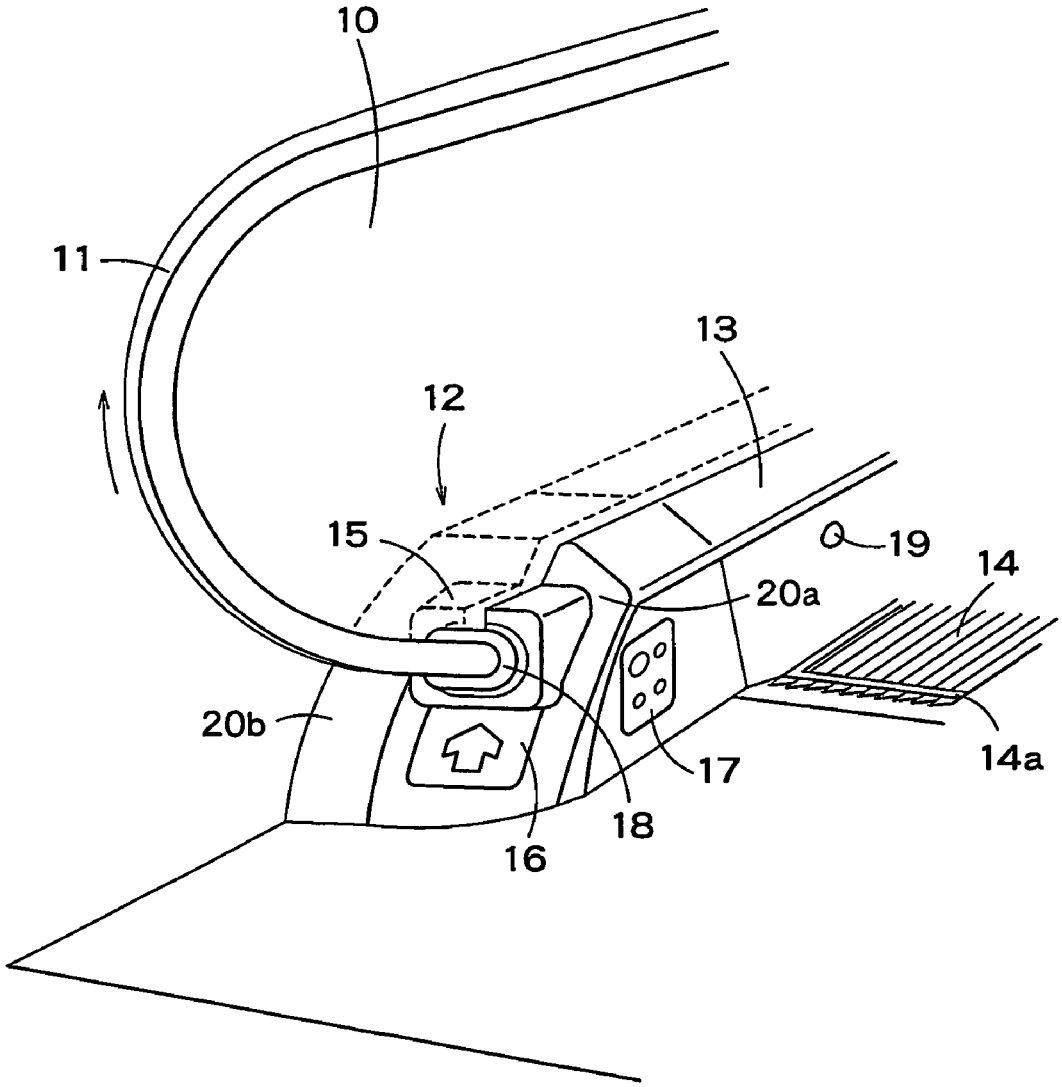
FIG. 1 is a perspective view of the entrance and its vicinity of an escalator according to an embodiment of the present invention.

FIG. 1 shows the entrance and its vicinity of an escalator according to the present invention. In FIG. 1, reference numeral 10 denotes a balustrade end. Balustrades, in general, are formed of a glass plate, a stainless plate, etc., and the present invention is applicable to any of such balustrades. Shown in FIG. 1 is a balustrade end 10 on the left side of the entrance, while a depiction of the right-side one is omitted. A handrail belt 11 is turned back at the balustrade end 10 and moves in the opposite direction. Reference numeral 12 denotes the whole of the skirt end portion. The skirt end portion 12 and its counterpart are mounted to both ends of a deck cover 13. Reference numeral 14 denotes a step with a yellow demarcation line 14*a* drawn on the upper surface along its periphery.

A belt entrance port 15 is provided in the front face of the skirt end portion 12 and, positioned beneath the belt entrance port 15, an indicator 16 for indicating the operating conditions, such as the moving direction of steps, of the escalator is mounted in the front face. The indicator 16 may be provided in either one or both of the end skirt portions 12 on both sides of the entrance.

Various switches and instruments for operation and safety of the escalator, such as an escalator-operating switch 17, an inlet switch 18 and a user detection sensor 19, are disposed in a concentrated manner in the inner-side surface of the skirt end portion 12. Auxiliary instruments, such as a vibration generator, may also be disposed. When a passenger's foot or leg is pressed against the inner side surface of the deck cover 13, the vibration generator detects the pressure and, if the pressure exceeds a first standard value, generates vibration which is transmitted via the inner side surface to the passenger. If the passenger, not noticing the vibration, further presses on the inner wall and the pressure exceeds a second standard value, the operation of the escalator is stopped.

The front face of such skirt end portion 12 is comprised of inclined surfaces 20*a*, 20*b*. The front inclined surfaces 20*a*, 20*b* are inclined at 5 to 30° with respect to a vertical plane. In addition, the inclined surface 20*a* is preferably inclined at 45° to 85° with respect to the direction of passengers' riding. The indicator 16 is mounted in the inclined surface 20*a* such that its display face conforms to the inclination of the inclined surface 20*a*.

Though the inclined surfaces 20*a*, 20*b* of the front face of the skirt end portion 12 preferably are gently curved surfaces with rounded corners, as in this embodiment, they may also be flat surfaces.

Figure 2:
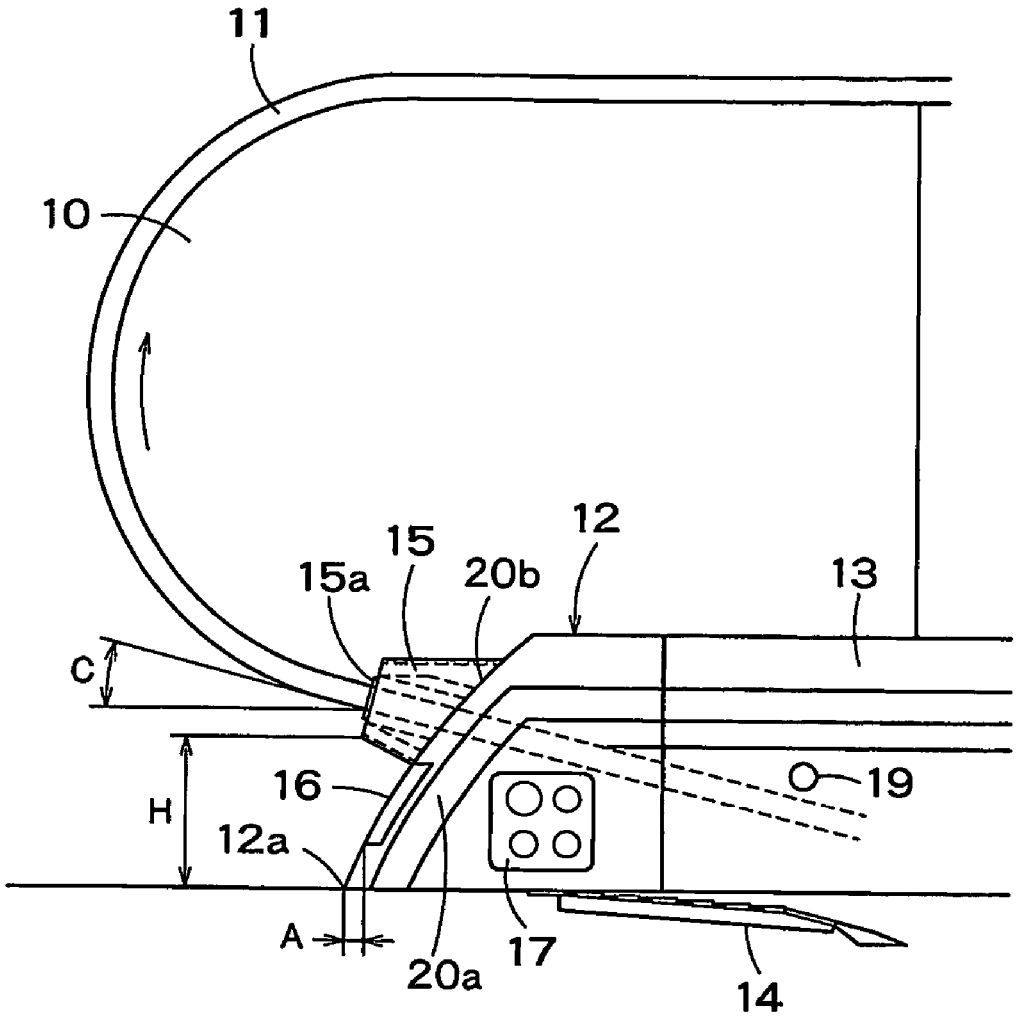
FIG. 2 is a side view of a balustrade end of the escalator.

FIG. 2 shows a side view of the balustrade end. The lower end edge 12*a* of the front face of the skirt end portion 12 is positioned forward of the belt entrance port 15 by a distance A. The belt entrance port 15 of the skirt end portion 12 projects from the front face of the skirt end portion 12, and the end surface 15*a* having an opening is inclined with respect to a horizontal plane. The angle of inclination is preferably 60 to 85°. Consequently, the moving direction of the handrail belt 11 moving in or out of the belt entrance port 15 of the skirt end portion 12 also makes a predetermined angle with a horizontal plane. In particular, to match the inclination angle of the end surface 15*a*, the direction of the velocity vector of the belt 11 preferably makes an angle C of 5 to 30° with a horizontal plane. The height H of the belt entrance port 15 from the floor is at least 170 mm.

The escalator of this embodiment, having the above-described construction, has the following advantages.

According to this embodiment, the skirt end portions 12, disposed on both sides of the entrance to the escalator, are each provided in the front face with the inclined surface 20*a* which is inclined with respect to a vertical plane as well as the direction of passengers' riding, and the indicator 16 is disposed in conformity with the inclination of the inclined surface 20*a*. Accordingly, as will be appreciated from FIG. 1 (which illustrates the case of ascent of the steps), even when a passenger, who intends to ride the escalator, comes close to the entrance, the Indicator 16 can be prevented from being hidden behind the balustrade end 10 and hardly visible to the passenger. Thus, the visibility of the indicator can be significantly enhanced. Even in the case where the indicator 16 is provided in only one of the skirt end portions 12, a lowering of the visibility of the indicator due to the position and the eye height of a passenger can be prevented.

In addition to the improvement in the visibility of the indicator 16, the inclined configuration of the front face of the skirt end portion 12 also has the following advantages. The lower end edge 12*a* of the skirt end portion 12 is positioned forward of the belt entrance port 15 by distance A. This makes it possible to provide a large space between the floor and the balustrade end 10. Furthermore, the belt entrance port 15 projects from the front inclined surface 20*a*, the end surface 15*a* of the belt entrance port 15 is inclined at 60 to 85° with respect to a horizontal plane, and the moving direction of the handrail belt 11 at the belt entrance port 15 makes an angle of 5 to 30° with a horizontal plane. This makes it possible to provide a large clearance between the floor and the belt entrance port 15. The possibility of passenger's baggage, etc. being caught between the floor and the balustrade end 10 can thus be lowered.

By making the height H of the belt entrance port 15 at least 170 mm, it becomes possible to prevent such an accident that a child falls down at the entrance and the child's head is caught between the floor and the handrail belt 11 and, in the worst case, the hair is caught in the belt entrance port 15.

Figure 3:
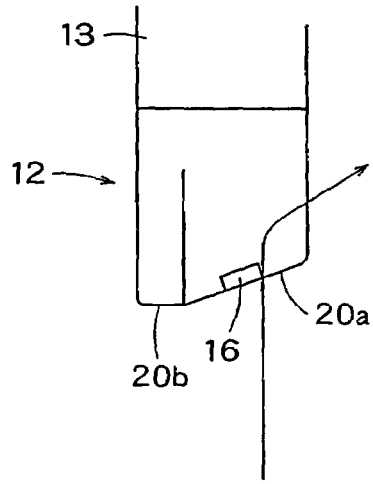
FIG. 3 is a top view of the balustrade end, illustrating the behavior of passenger's baggage or the like upon hitting against the front face of the balustrade end.
Figure 4:
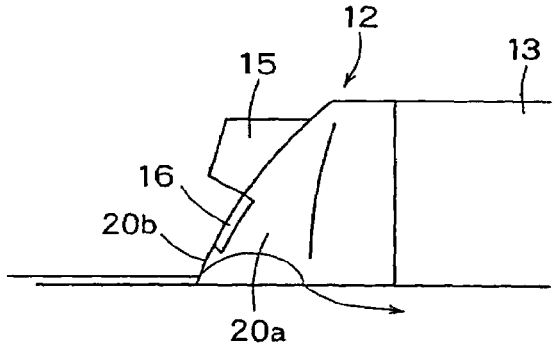
FIG. 4 is a side view of the balustrade end, illustrating the behavior of passenger's baggage or the like upon hitting against the front face of the balustrade end.
Figure 5:
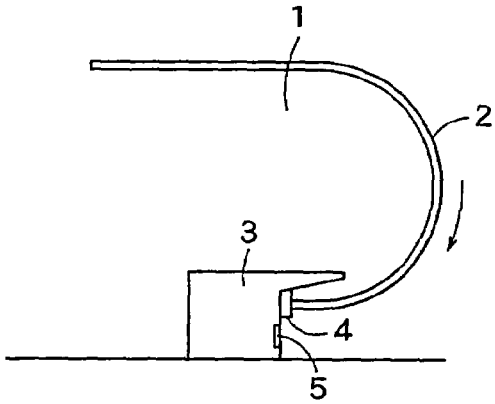
FIG. 5 is a side view of a balustrade end of a conventional escalator.

According to this embodiment, the front face of the skirt end portion is comprised of the inclined surfaces 20*a*, 20*b* and, in addition, the inclined surface 20*a* is inclined with respect to the direction of passengers' riding. Accordingly, when a passenger, upon riding the escalator, lets a shopping cart or the like hit against the front inclined surface 20*a* of the skirt end portion 12, it is guided to the direction of the passenger's movement, as shown in FIGS. 3 and 4. This can prevent a jam at the entrance as well as a falling accident of a passenger caused by rebound of a shopping cart toward the floor.

Further according to this embodiment, various switches and instruments for operation and safety of the escalator, such as an escalator-operating switch 17, an inlet switch 18 and a user detection sensor 19, are disposed in a concentrated manner in the inner-side surface of the skirt end portion 12. This can improve the working efficiency for their maintenance by the operator.

Such skirt end portion 12 can be constructed as an exchangeable unitized structure mountable to the balustrade end 10. This can improve the efficiency of the installation operation.

While the present invention has been described in terms of the preferred embodiment, the invention is also applicable to a balustrade end of a so-called man-conveyor in which steps move horizontally.

The invention claimed is:

1. An escalator, having a pair of balustrades disposed on both sides of traveling steps, comprising:

a balustrade end configured to turn back a handrail belt wound around each of said balustrades;

a skirt end portion having a belt entrance port configured to receive the handrail belt, and an outer edge of the skirt end portion furthest away from the traveling steps extends further in an axial direction of the traveling steps than an inner edge of the skirt end portion closest to the traveling steps to guide items towards the traveling steps; and an indicator configured to indicate operating conditions of the escalator, wherein a front face of the skirt end portion includes an inclined surface at a predetermined angle with a vertical plane, and a display face of the indicator conforms to the inclination of the inclined surface.

2. The escalator according to claim 1, wherein the angle of the inclined surface with a vertical plane is 5 to 30° and an angle of the inclined surface with the axial direction of the traveling steps is 45 to 85°.

3. The escalator according to claim 2, wherein a lower end edge of the front face of the skirt end portion is positioned forward of the belt entrance port.

4. The escalator according to claim 3, wherein the belt entrance port of the skirt end portion projects from the front face of the skirt end portion and has an inclined end surface having an opening.

5. The escalator according to claim 4, wherein the end surface of the belt entrance port is inclined at an angle of 60 to 85° with respect to a horizontal plane.

6. The escalator according to claim 5, wherein a moving direction of the handrail belt at the belt entrance port makes an angle of 5 to 30° with a horizontal plane.

7. The escalator according to any one of claims 3 to 6, a height of the belt entrance port of the skirt end portion from a floor is at least 170 mm.

8. The escalator according to claim 1, wherein the front face of the skirt end portion comprises a gently curved surface with rounded corners.

9. The escalator according to claim 1, wherein the skirt end portion is adapted for concentrated arrangement of various instruments such as a switch, a sensor and an indicator.

10. A skirt end structure of an escalator having a pair of balustrades disposed on both sides of traveling steps, said skirt end structure is configured to be mounted in a balustrade end configured to turn back a handrail belt wound around each said balustrade, comprising:

a belt entrance port configured to receive the handrail belt;

an indicator configured to indicate operating conditions of the escalator; and a front face having the belt entrance port thereon and including an inclined surface at a predetermined angle with a vertical plane and an outer edge of the front face furthest away from the traveling steps extends further in an axial direction of the traveling steps than an inner edge of the skirt end portion closest to the traveling steps to guide items towards the traveling steps, wherein a display face of the indicator conforms to an inclination of the inclined surface.

11. The skirt end structure according to claim 1O, wherein the skirt end structure is an exchangeable unitized structure configured to be mountable to the balustrade end.

12. The skirt end structure according to claim 11, wherein the angle of the inclined surface with a vertical plane is 5 to 30° and an angle of the inclined surface with the axial direction of the traveling steps is 45 to 85°.

13. The skirt end structure according to claim 12, wherein a lower end edge of the front face is positioned forward of the belt entrance port.

14. The skirt end structure according to claim 13, wherein the belt entrance port projects from the front face and has an inclined end surface having an opening.

15. The skirt end structure according to claim 14, wherein the end surface of the belt entrance port is inclined at an angle of 60 to 85° with respect to a horizontal plane.

16. The skirt end structure according to claim 15, wherein a moving direction of the handrail belt at the belt entrance port makes an angle of 5 to 30° with a horizontal plane.

17. The skirt end structure according to any one of claims 13 to 16, wherein a height of the belt entrance port from a floor is at least 170 mm.

18. The skirt end structure according to claim 10 or 11, wherein the front face comprises a gently curved surface with rounded corners.

* * * * *